US006618007B1

(12) United States Patent
Miller

(10) Patent No.: US 6,618,007 B1
(45) Date of Patent: Sep. 9, 2003

(54) ADAPTIVE WEIGHT CALCULATION PREPROCESSOR

(75) Inventor: Thomas W. Miller, Yorba Linda, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/162,486

(22) Filed: Jun. 4, 2002

(51) Int. Cl.[7] ..... H01Q 3/26
(52) U.S. Cl. ..... 342/375; 342/373
(58) Field of Search ..... 342/368, 373, 342/375, 378, 383

(56) References Cited

U.S. PATENT DOCUMENTS 4,771,289 A * 9/1988 Masak ..... 342/383
2002/0057219 A1 * 5/2002 Obayashi ..... 342/372
2002/0158801 A1 * 10/2002 Crilly et al. ..... 342/378

* cited by examiner

*Primary Examiner*—Dao Phan
(74) *Attorney, Agent, or Firm*—Leonard A. Alkov; Glenn H. Lenzen, Jr.

(57) ABSTRACT

In accordance with one aspect of the present invention, a preprocessor is provided for use in an adaptive antenna array. The purpose of the preprocessor is to modify the incoming signals received by each antenna of an antenna array in such a manner as to reduce the amount of computation necessary to compute the adaptive array weights. In an adaptive array, the weight computation process generally requires calculations using digital electronics, which tend to be computationally intensive when applied to wideband, high sample rate signals. The preprocessor of the present invention solves this problem by filtering the data in such a manner as to reduce the sample rate of the signal without losing the essential characteristics of the signal. The preprocessor includes an input terminal for receiving an electromagnetic signal from an antenna element of the adaptive antenna array, and a frequency smearer operatively coupled to the input terminal. The frequency smearer is provided in order to smear the electromagnetic signal by varying the frequency of the electromagnetic signal across a predetermined frequency band and outputting the smeared electromagnetic signal to an averaging circuit. The averaging circuit, which is operatively coupled to the output of the frequency smearer, repetitively computes and outputs an average with respect to time of the smeared electromagnetic signal.

13 Claims, 6 Drawing Sheets

ADAPTIVE WEIGHT CALCULATION PREPROCESSOR

TECHNICAL FIELD

The present invention generally relates to a preprocessor for preprocessing a plurality of electromagnetic signals received by an adaptive antenna array. More specifically, the present invention relates to a preprocessor that frequency smears and averages the electromagnetic signals such that an output signal of the preprocessor contains sufficient information to enable an adaptive weight calculator to calculate an accurate weighting coefficient for the electromagnetic signal, which weighting coefficient is then used to eliminate interference contained in the electromagnetic signal. The present invention is also applicable to adaptive processing systems in general, including adaptive filters.

BACKGROUND ART

Adaptive antenna array systems adaptively reconfigure the signals received by an array of antenna elements generally for the purpose of improving the reception of the received signal in the presence of jamming, noise, and other interference. An adaptive array provides this capability by modifying the receive gain pattern of an antenna array. For example, one can adjust the receive antenna pattern to maximize the receive gain in the angular direction of a desired signal source while simultaneously minimizing the gain in the direction of an interference source. The gain pattern is modified by adjusting the adaptive array weighting coefficients; in the simplest case, there is one coefficient for each antenna element of the antenna array. If the angular locations of the signal/interference sources are known, the value of the weighting coefficients that achieve the desired gain pattern can be calculated without further information (assuming the antenna array is well calibrated). However, if their locations are unknown, as is often the case, the weighting coefficients can only be determined from information extracted from the signals (including interference) received by the array. The latter approach, which describes the adaptive processing concept, has proven quite effective and, as a result, has found use in many military and commercial radar, communication, and navigation systems.

An adaptive array antenna system (which may be more generally referred to as a spatial filter, or smart antenna) generally includes a plurality of antenna elements for receiving electromagnetic signals. The output of each antenna element is generally provided to an adaptive weight calculator that is programmed to calculate a weighting coefficient, which is then applied to the electromagnetic signal received by the antenna element in order to create the desired array pattern. For example, in military applications the adaptive weight calculator may be "looking" to eliminate jamming signals. If a jamming signal is detected, the adaptive weight calculator would eliminate the jamming signal or reduce its impact by, for example, substantially reducing the gain on such signal.

In order to perform the adaptive weight calculations in an accurate and timely manner, information must be extracted from the output of each antenna element. In cases where the antenna array consists of hundreds or even thousands of antenna elements, the processing power required to perform the weight calculations can be significant.

In an effort to reduce the required processing power, "shortcuts" have been developed. For example, the number of samples provided the adaptive weight calculator for use in the weight calculation may be reduced by a predetermined factor, for example, a factor of 10, by only using every $10^{th}$ sample in the weight calculation (instead of using every sample). Such an approach is referred to as sparse sampling. This is appropriate in situations where the interference waveform and location do not change much (e.g., a tone jammer or interference signal emanating from a stationary or slowly moving transmitter), where the reduced number of samples available for use by the adaptive weight calculator is often not critical. In this case, the use of fewer samples in the weight calculation significantly reduces the computation requirements without significantly affecting the quality of the weight calculation. However, if the interference signal is changing such as in the case of a pulsed interference signal, reducing the number of samples provided the adaptive weight calculator could result in non-recognition and thus non-cancellation of the interference signal. Using the above example to illustrate the point, the interference may only be present during the nine samples that were skipped, in which case the presence of the interference would not be sensed by the weight calculator and therefore would not be cancelled by the adaptive array.

Therefore, it would be advantageous to have an adaptive antenna array system that could identify both tone and pulse interference signals while still achieving the computational savings obtained by sparse sampling as described above in the example.

SUMMARY OF THE INVENTION

In accordance with one aspect of the present invention, a preprocessor is provided for use in an adaptive antenna array. The preprocessor reduces the sample rate of the signal prior to inputting the signal to the weight calculator (thereby reducing computation in the weight calculator), without "missing" the pulsed interference signal as might occur with sparse sampling. The preprocessor is designed to achieve similar performance for other interference waveforms, including continuous wave (CW) tone interference. The preprocessor includes an input terminal for receiving an electromagnetic signal from an antenna element of the adaptive antenna array, and a frequency smearer operatively coupled to the input terminal. The frequency smearer is provided in order to smear the electromagnetic signal by varying a frequency of the electromagnetic signal across a predetermined frequency band and outputting the smeared electromagnetic signal to an averaging circuit. The averaging circuit, which is operatively coupled to the output of the frequency smearer, repetitively computes and outputs an average with respect to time of the smeared electromagnetic signal. Smearing reduces the possibility that a CW tone interference will be eliminated by the smoothing process (which would lead to an incorrect weight calculation that may prevent the adaptive array from nulling that interference).

In accordance with another aspect of the present invention, a preprocessor is provided in which a chirp waveform is applied to the electromagnetic signal in order to linearly vary the frequency of the electromagnetic signal across the predetermined frequency band. A variation on this approach is the use of other types of waveforms that provide the same effect, that of smearing the frequency content of the interference signals so that they are preserved in the averaging circuit.

In accordance with a further aspect of the present invention, a preprocessor is provided that includes means for sampling the smeared electromagnetic signal. The means for sampling creates a plurality of samples, which are provided to the averaging circuit in order to compute an average of a portion of the plurality of samples, thereby computing an average of that plurality of samples.

In accordance with another aspect of the present invention, an adaptive antenna array system is provided, which includes an array of antenna elements each for receiving an electromagnetic signal. The system further includes an input for receiving the electromagnetic signal from each of the plurality of antenna elements, and a frequency smearer operatively coupled to the input for smearing the electromagnetic signal by varying a frequency of the electromagnetic signal across a predetermined frequency band. The frequency smearer outputs the smeared electromagnetic signal via an output to an averaging circuit, which is operatively coupled to the output of the frequency smearer. The averaging circuit repetitively computes and outputs an average with respect to time of the smeared electromagnetic signal. The averaging circuit provides the average to an adaptive weight calculator, which calculates and outputs weighting coefficients based upon the average with respect to time of the smeared electromagnetic signal to a beam former that is also operatively coupled to the input in order to receive the electromagnetic signal from each of the plurality of antenna elements. The beam former serves to combine the electromagnetic signal from each of the plurality of antenna elements with the weighting coefficients to produce an output signal for the adaptive antenna array system.

In accordance with still another aspect of the present invention, a method of calculating weighting coefficients for an electromagnetic signal received by an adaptive antenna array is provided. The method includes smearing a frequency of the electromagnetic signal by varying the frequency across a predetermined frequency band, and sampling the smeared electromagnetic signal to create a plurality of samples thereof. The method further includes computing an average of a portion of the plurality of the samples to create an averaged sample, and, finally, using the averaged sample to calculate the weighting coefficients for the electromagnetic signal.

DISCLOSURE OF INVENTION

Figure 1:
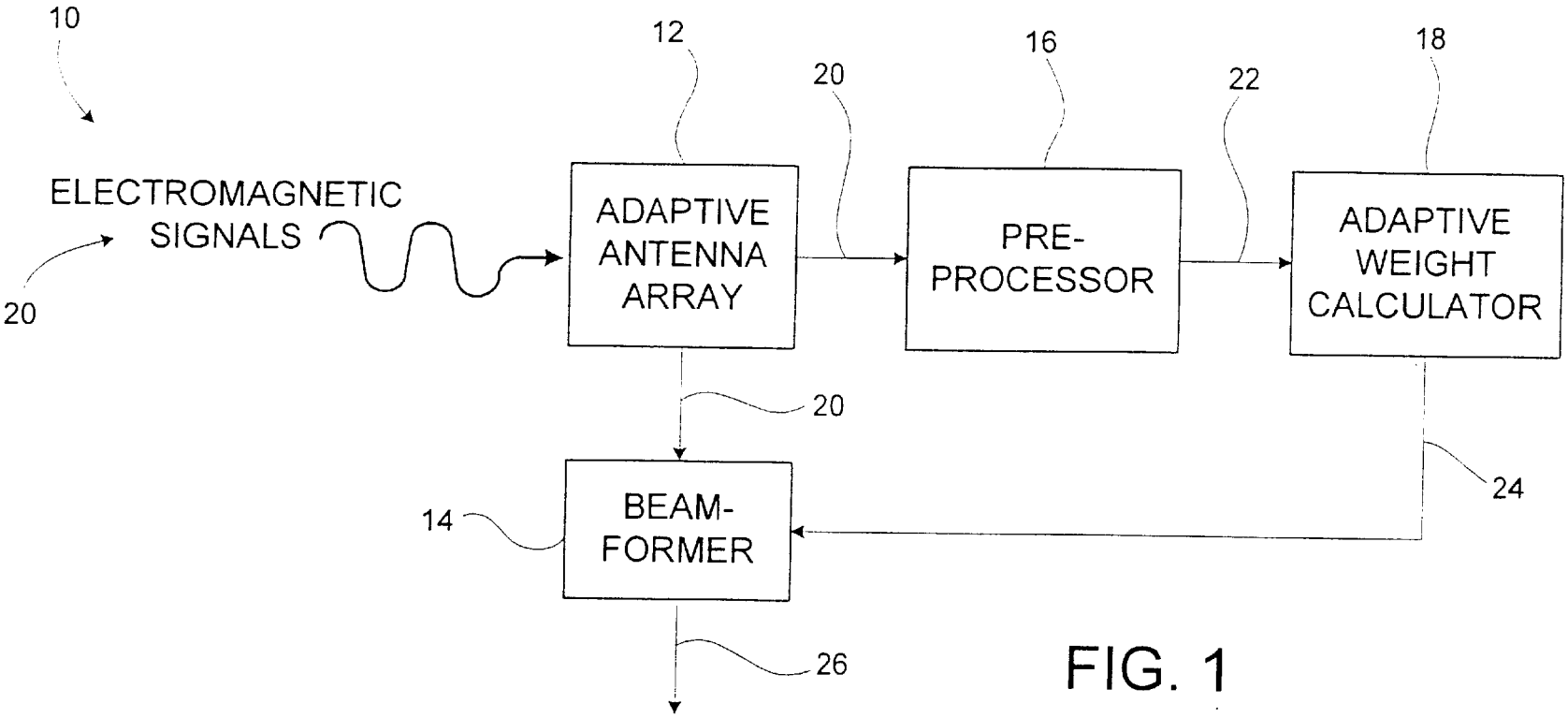
FIG. 1 is a top-level block diagram of an adaptive antenna array system in accordance with the present invention.

The present invention will now be described in detail with reference to the drawings. In the drawings, like reference numerals are used to refer to like elements throughout.

Referring to FIG. 1, an adaptive antenna array system 10 in accordance with the present invention is illustrated in block form. The system 10 includes an array 12 of antenna elements, a beam former 14, a preprocessor 16 and an adaptive weight calculator 18.

In operation the array 12 receives electromagnetic signals 20. The array 12 outputs the received signals 20 to both the preprocessor 16 and the beam former 14. The preprocessor 16, the operation of which will be described in more detail below, processes the signals 20 and provides output signals 22 to the adaptive weight calculator 18. The adaptive weight calculator uses output signals 22 to calculate weighting coefficients 24, which are output to the beam former 14. The beam former 14 applies the weighting coefficients 24 to the signals 20 to form antenna array beam former signal output 26.

Figure 2:
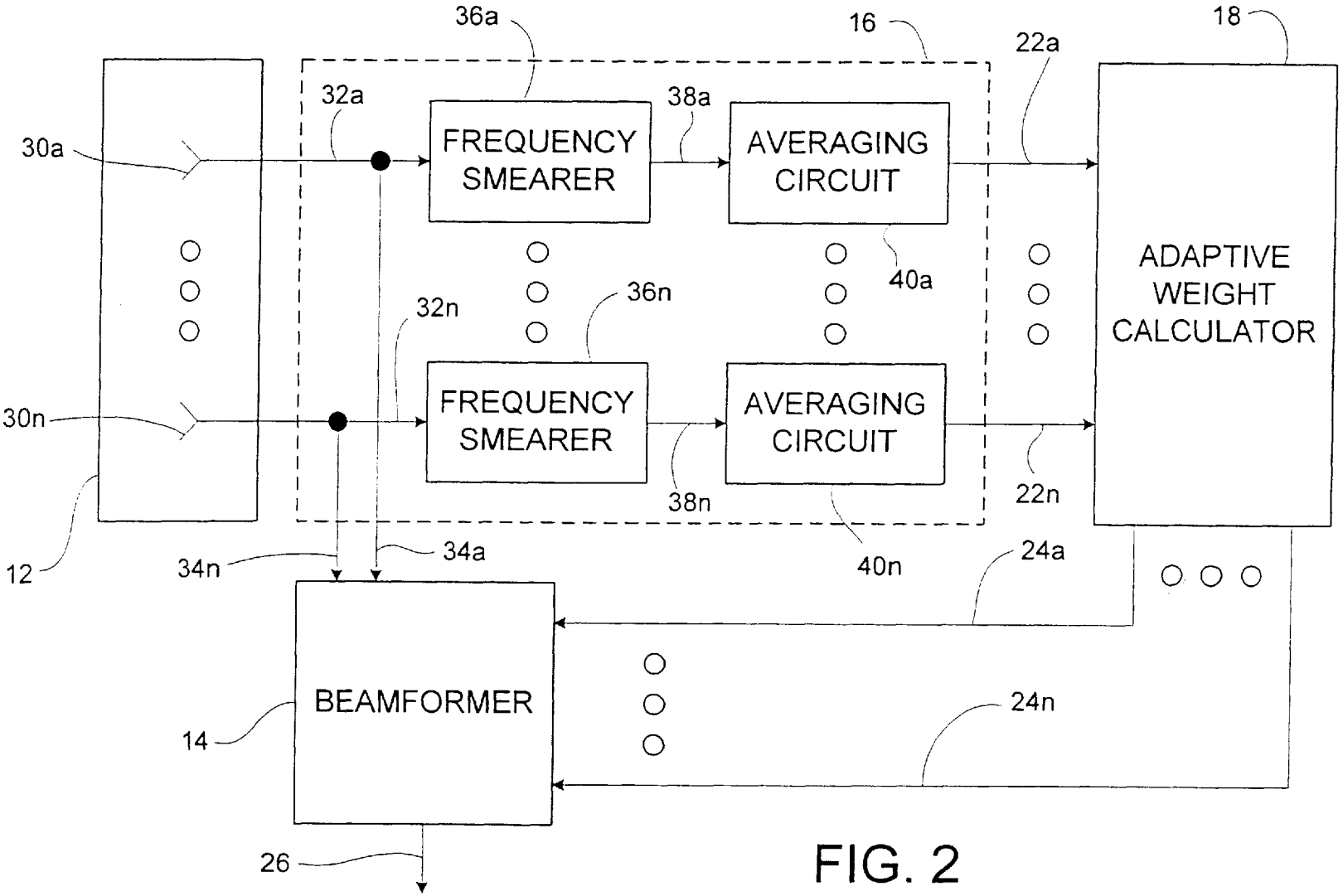
FIG. 2 is a block diagram of an adaptive antenna array system in accordance with the present invention illustrating functional components of the preprocessor.

FIG. 2 illustrates in block form certain of the functional components of the preprocessor 16 in greater detail. As discussed previously, signals 20 are received by antenna elements 30*a* through 30*n* of antenna array 12. The number of elements in the array will generally vary depending on system requirements. The signals 20 are transmitted along lines 32*a*–32*n* to the preprocessor 16 and along lines 34*a*–34*n* to the beam former 14.

Turning now to the operation of the preprocessor 16, the description of which will be limited to signal 20 on line 32*a* for sake of simplicity. However, one skilled in the art will appreciate that the same process will be taking place in parallel for the signals transmitted along the other lines, such as line 32*n* illustrated in FIG. 2.

The preprocessor 16 receives signal 20 along line 32*a*. The signal 20 is provided to a frequency smearer 36*a*, which includes circuitry designed to vary (e.g., sweep or shift) the frequency of the signal 20 a predetermined amount over a predetermined time. In one embodiment of the present invention, the signal 20 is multiplied by a complex weight in order to shift the frequency of the signal 20. For example, if the incoming signal 20 were a tone at a frequency of 5 MHz, and the frequency smearer 36*a* were designed to sweep the signal 20 over a 10 MHz bandwidth, then an output 38*a* of the frequency smearer 36*a* would be a signal that ranged in frequency from 0 MHz to 10 MHz. In this embodiment of the present invention, output 38*a* is swept linearly from 0 MHz to 10 MHz over a one (1) millisecond time period. Other waveforms may also be employed to achieve frequency smearing, including non-linear chirp.

The output 38*a* of the frequency smearer 36*a* is provided to averaging circuit 40*a*. The averaging circuit 40*a*, as its name suggests, averages output 38*a* to create a single output sample 22*a* that is then provided to the adaptive weight calculator 18. If it is desired that the averaging be performed by digital circuitry, the averaging circuit 40*a* would include an A/D converter for digitally sampling output 38A. Regardless, however, of whether performed with analog or digital circuitry, the averaging process, which will be described in more detail below, results in the output sample 22*a* that reflects the presence of a pulsed jamming signal, thereby enabling the adaptive weight calculator 18 to calculate appropriate weighting coefficients while using only a portion of the signals 20 received by the antenna array 12.

As already mentioned, the adaptive weight calculator 18 receives output samples 22*a*–22*n* from the preprocessor 16.

The adaptive weight calculator 18 uses known signal processing techniques to calculate the required weighting coefficients 24. The calculated weighting coefficients 24*a*–24*n* are output to the beam former 14. The beam former 14 combines the signals 20 with the weighting coefficients 24*a*–24*n*, thereby creating the antenna array pattern 26.

Figure 3:
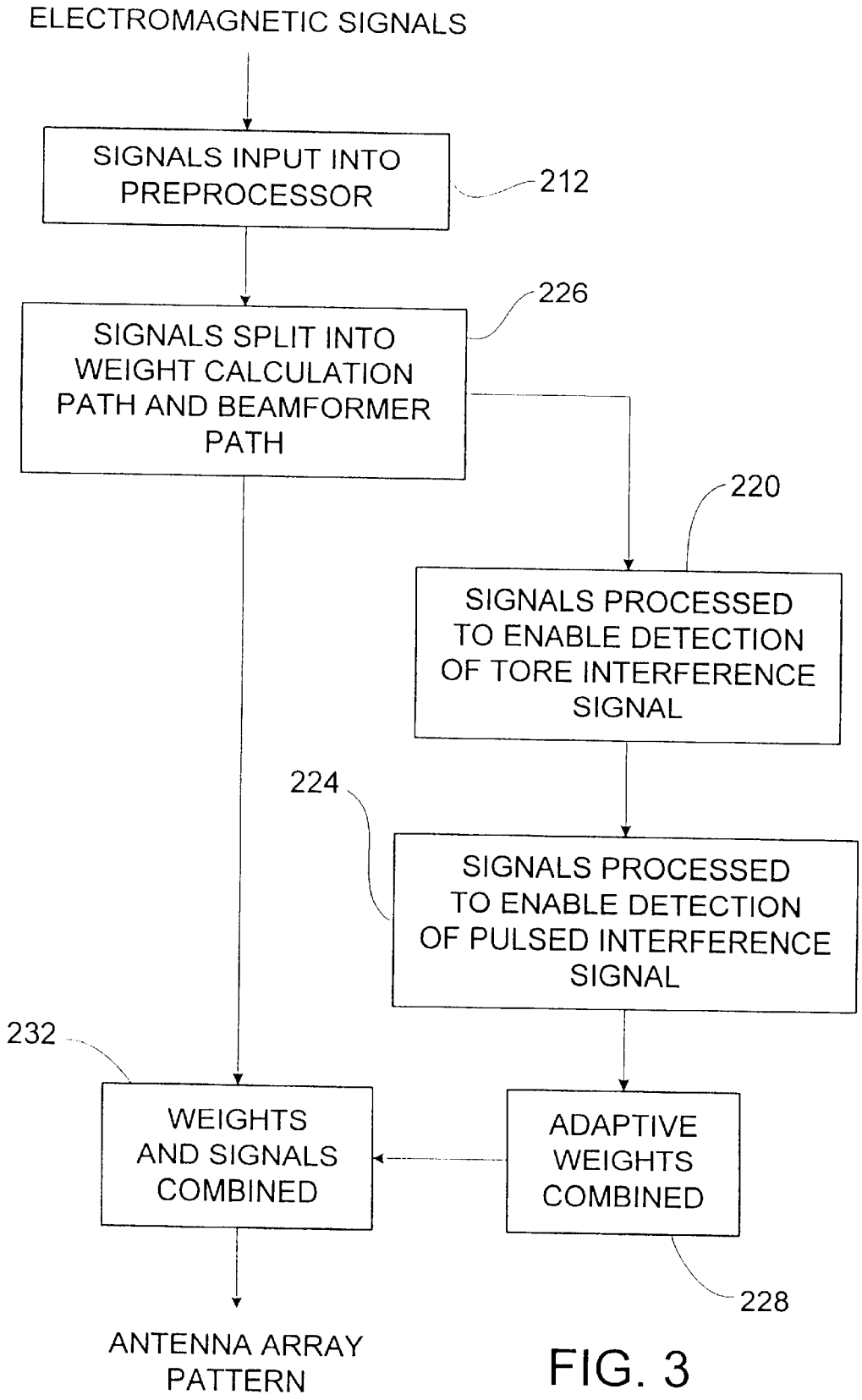
FIG. 3 is a flow diagram of a method of processing electromagnetic signals received by an adaptive antenna array system using the preprocessor of the present invention.

The operation of adaptive antenna array system 10 will now be described more fully by reference to FIGS. 3–5. As shown in step 212, the electromagnetic signals 20 are received by antenna elements 30*a*–30*n* and transmitted to the preprocessor 16. In step 216, the signals 20 are split and transmitted along what will be termed a weight calculation path and a beam former path. The beam former path provides the signals 20 directly to the beam former 14, although generally on a time-delayed basis. The weight calculation path provides the signals 20 to the preprocessor 14 for eventual use in calculating weighting coefficients 24.

Moving to step 220, the signals 20, which are generally a compilation of multiple signals at varying frequencies, are transmitted along the weight calculation path and first preprocessed so as to enable the adaptive weight calculator to detect the presence of a tone jamming signal. A tone jamming signal present in signal 20 may be undesirably lost if signal 20 is subjected directly to the averaging process that will be described below. Specifically, if the constant tone jamming signal represented in FIG. 4A was a component of signal 20, its value when averaged with respect to time would be effectively zero. This becomes clearer if referring to FIG. 4B, which graphically represents the tone jamming signal of FIG. 5A digitally sampled. As one skilled in the art can appreciate, if the represented samples were averaged, the result would be zero. Therefore, the existence of the tone jamming signal would not be represented in the output 22 ultimately sent to the adaptive weight calculator, and thus the weighting coefficient 24 calculated by the adaptive weight calculator would fail to perform its in tended function of canceling or nulling the tone jamming signal.

Figure 4A:
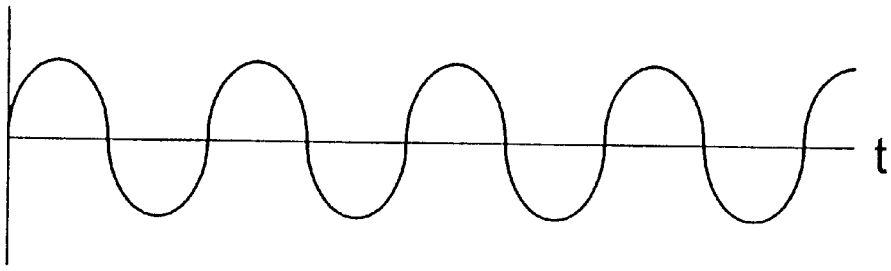
FIG. 4A is a graphical representation of a tone interference signal in the time domain.
Figure 4B:
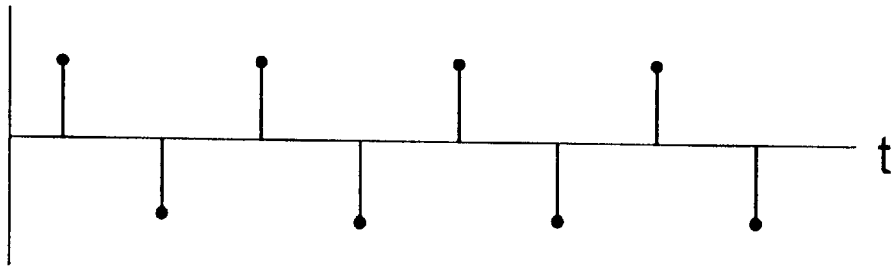
FIG. 4B is a representation of the tone interference signal illustrated in FIG. 4A digitally sampled.
Figure 4C:
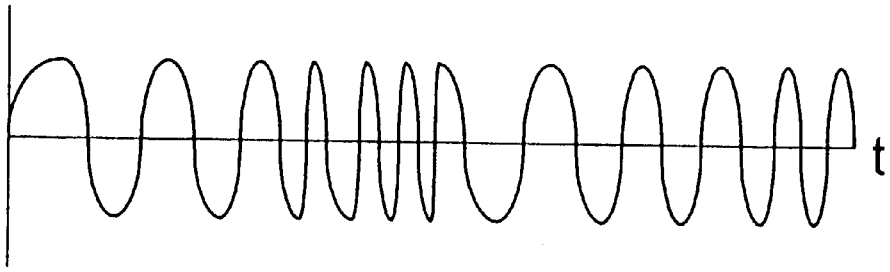
FIG. 4C is a graphical representation of the tone interference signal of FIG. 4A after it has been frequency smeared.
Figure 4D:
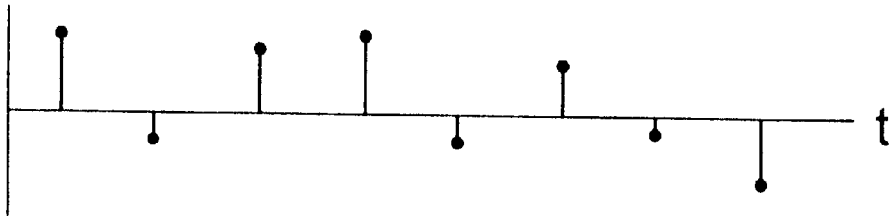
FIG. 4D is a representation of the tone interference signal illustrated in FIG. 4C digitally sampled.

To combat this problem, the signals 20 are frequency smeared prior to averaging. For example, the signals 20, which would include any tone jamming signal, may be multiplied with a chirp wave form, a wave form whose frequency is linearly varied over time, thereby resulting in an output signal that has a corresponding linear variation in frequency (see FIG. 4C). As one skilled in the art can appreciate, the signal represented in FIG. 4C, when digitally sampled, yields samples graphically represented in FIG. 4D. When the samples illustrated in FIG. 4D are averaged, the net result is something other than zero. Accordingly, the signal 22 that is output to the adaptive weight calculator will reflect the existence of the tone jamming signal, thereby enabling the adaptive weight calculator to calculate a weighting coefficient, which accounts for and deals with the existence of the tone jamming signal.

After the signal is smeared for purposes of enabling detection of tone jamming signals, signal 38 is provided to the averaging circuit 40, as indicated in step 224. The averaging circuit 40 will process signal 38 so as to enable the adaptive weight calculator to detect the presence of a pulse jamming signal.

Figure 5A:
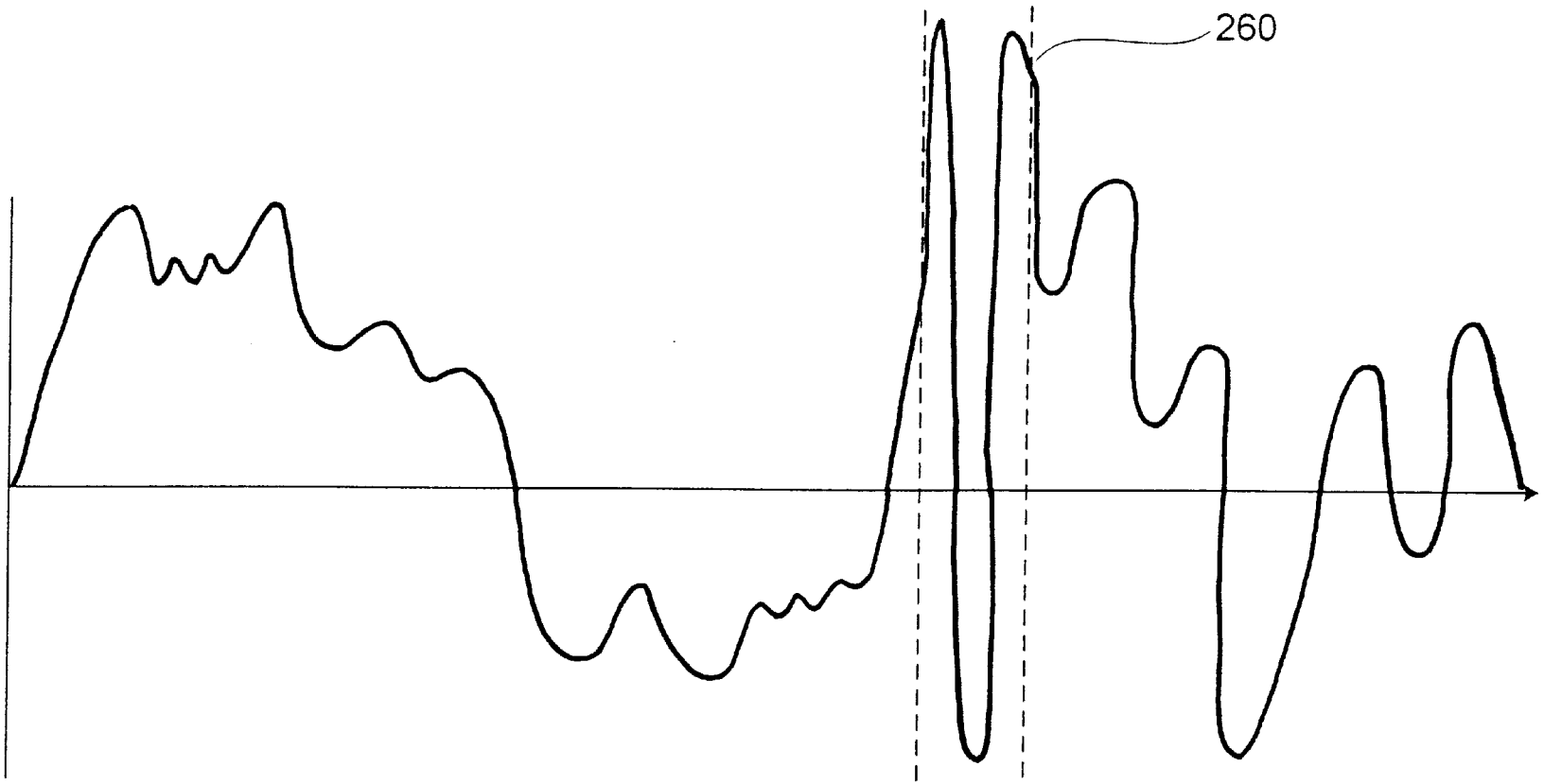
FIG. 5A is a graphical representation of an electromagnetic signal to be preprocessed by a preprocessor in accordance with the present invention.
Figure 5B:
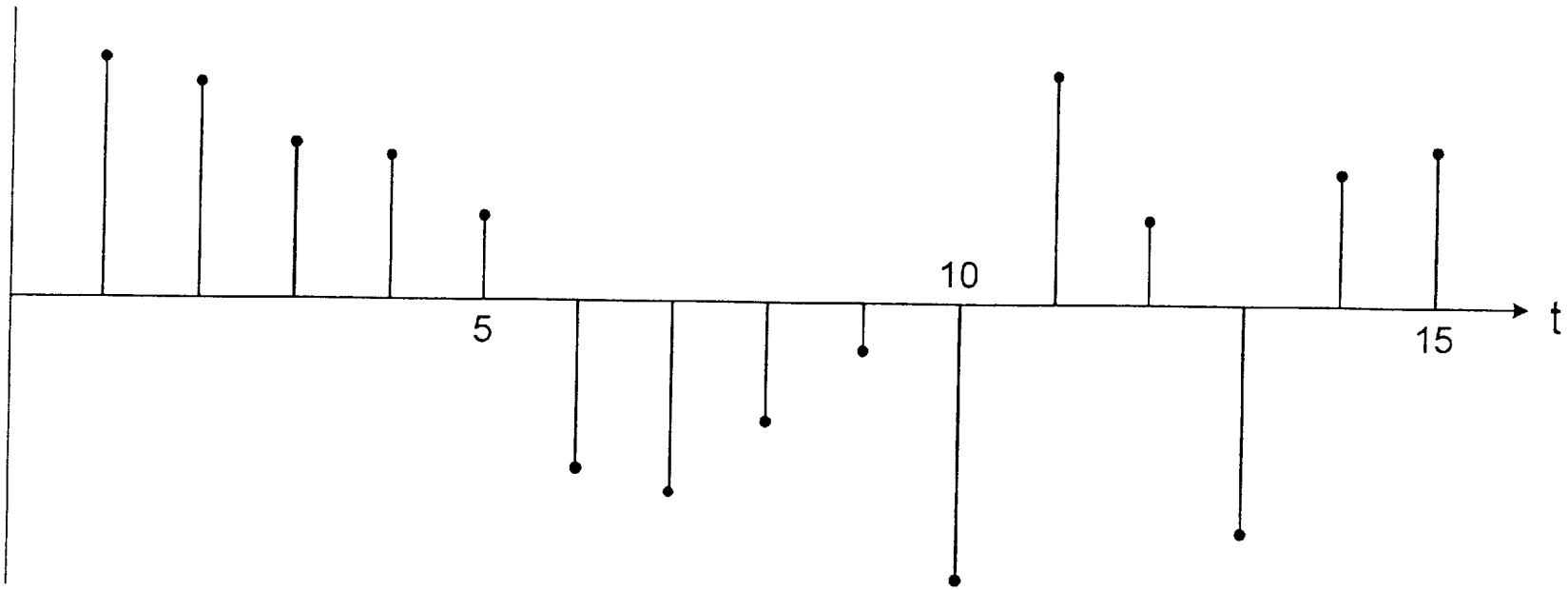
FIG. 5B is a representation of the electromagnetic signal illustrated in FIG. 5A digitally sampled

As discussed previously, prior attempts to reduce the required processing power in the adaptive weight calculator was simply to output only one sample in, for example, 10. The problem with this solution can be seen by reference to FIGS. 5A and 5B. FIG. 5A represents signal 20 in the time domain. Portion 260, illustrated in FIG. 5A by the dashed lines, indicates the presence of a pulsed interference signal. FIG. 5B represents signal 20 when digitally sampled. If the adaptive weight calculator was only provided every $10^{th}$ sample beginning, for example, with sample 5, the presence of the pulsed interference signal would not be reflected in the samples provided to the adaptive weight calculator (i.e., samples 5 and 15). Accordingly, the adaptive weight calculator would be unable to calculate the appropriate weighting coefficient to cancel or null the pulsed interference signal.

In contrast, the present invention would average, for example, every 10 samples to create an averaged sample. Thus, sample 10, which is indicative of the pulsed interference signal, would be factored into the averaged sample that is to be provided into the adaptive weight calculator. The averaging process, however, is not a simple averaging process (i.e., add 10 samples together and divide the result by 10). Instead, the averaging circuit goes through the following process to calculate the "averaged sample" to be output to the adaptive weight calculator. Specifically, the averaging circuit band partitions each signal received by an antenna element. In the present embodiment of this invention, this band partitioning is accomplished by applying a Fast Fourier Transform (with N equaling 256) to each signal, thereby splitting the signal into sub-bands. The sub-bands are then passed to a band-pass filter in order to reduce the number of bands to be further processed. In this embodiment, the band-pass filter reduces the number of sub-bands from 256 to 128. Each sub-band after application of a weight, is summed with the same sub-band of the signals received by the other antenna elements in order to create a single set of sub-bands. The amplitude of each of the combined 128 sub-bands is now normalized in order to remove variation between the sub-bands caused by the adaptive array processing, thereby reducing any time delay distortion caused by the adaptive array. Finally, the sub-bands are subjected to an inverse Fast Fourier Transform and the resulting output provided to the adaptive weight calculator 18 for further use.

To complete the process, in step 228, the adaptive weight calculator 18 uses the signal it received to calculate weighting coefficients 24, which it then outputs to the beam former 14. Then in step 232, the beam former 14 (also known as an adaptive array applicator) applies the weighting coefficients 24 to the signals 20, which, as previously discussed, were supplied the beam former 14 via the beam former path and outputs antenna array pattern 26.

Ideally, the weighting coefficients 24 will be calculated and applied such that a null would be applied in the direction of the recognized tone and pulsed jamming signals. Techniques for calculating and applying the weighting coefficients are known in the art and generally involve complex multiplication and summation operations.

As is evident from the detailed discussion above, the present invention results in an adaptive antenna array system that that operates with less required computation while continuing to reliably recognize both tone and pulsed jamming signals, thereby preserving the interference rejection capability of the adaptive array.

Although particular embodiments of the invention have been described in detail, it is understood that the invention is not limited correspondingly in scope, but includes all changes, modifications and equivalents coming within the spirit and terms of the claims appended hereto.

What is claimed is:

1. A preprocessor for use in an adaptive antenna array comprising:

(a) an input terminal for receiving an electromagnetic signal from an antenna element of the adaptive antenna array;

(b) a frequency smearer operatively coupled to the input terminal for smearing the electromagnetic signal by varying a frequency of the electromagnetic signal across a predetermined frequency band and outputting the smeared electromagnetic signal via an output; and (c) an averaging circuit operatively coupled to the output of the frequency smearer for repetitively computing and outputting an average with respect to time of the smeared electromagnetic signal.

2. A preprocessor according to claim 1, wherein the frequency smearer applies a complex weight to the electromagnetic signal in order to vary the frequency of the electromagnetic signal.

3. A preprocessor according to claim 2, wherein the complex weight is a chirp waveform that shifts the frequency of the electromagnetic signal across the predetermined frequency band.

4. A preprocessor according to claim 3, wherein the chirp waveform varies linearly with time.

5. A preprocessor according to claim 3, wherein the chirp waveform varies non-linearly with time.

6. A preprocessor according to claim 1, further comprising means for sampling the smeared electromagnetic signal to create a plurality of samples thereof, wherein the averaging circuit computes an average of a portion of the plurality of samples, thereby computing an averaged sample.

7. A preprocessor according to claim 6, wherein the averaging circuit computes a plurality of averaged samples, which are representative of the plurality of samples of the smeared electromagnetic signal.

8. An adaptive antenna array system comprising:

(a) an array of antenna elements, each antenna element for receiving an electromagnetic signal;

(b) an input for receiving the electromagnetic signal from each of the antenna elements;

(c) a frequency smearer operatively coupled to the input for smearing the electromagnetic signal by varying a frequency of the electromagnetic signal across a predetermined frequency band and outputting the smeared electromagnetic signal via an output;

(d) an averaging circuit operatively coupled to the output of the frequency smearer for repetitively computing and outputting an average with respect to time of the smeared electromagnetic signal via an output;

(e) an adaptive weight calculator operatively coupled to the output of the averaging circuit for calculating and outputting weighting coefficients via an output; and (f) a beam former operatively coupled to the input in order to receive the electromagnetic signal from each of the plurality of antenna elements and operatively coupled to the output of the adaptive weight calculator in order to receive the weighting coefficients wherein, the beam former combines the electromagnetic signal from each of the plurality of antenna elements with the weighting coefficients to produce an output signal for the adaptive antenna array system.

9. An adaptive antenna array according to claim 8, wherein the frequency smearer applies a complex weight to the electromagnetic signal in order to vary the frequency of the electromagnetic signal.

10. An adaptive antenna array according to claim 9, wherein the complex weight is a chirp waveform that linearly varies the frequency of the electromagnetic signal across the predetermined frequency band.

11. An adaptive antenna array system according to claim 8, further comprising means for sampling the smeared electromagnetic signal to create a plurality of samples thereof, wherein the averaging circuit computes an average of a portion of the plurality of samples, thereby computing an averaged sample.

12. An adaptive antenna array according to claim 11, wherein the averaging circuit computes a plurality of averaged samples, which are representative of the plurality of samples of the smeared electromagnetic signal.

13. A method of preprocessing an electromagnetic signal received by an adaptive antenna array comprising the steps of:

(a) smearing a frequency of the electromagnetic signal by varying the frequency across a predetermined frequency band;

(b) sampling the smeared electromagnetic signal to create a plurality of samples thereof;

(c) computing an average of a portion of the plurality of the samples to create an averaged sample; and (d) outputting the averaged sample to an adaptive weight calculator, wherein the adaptive weight calculator calculates the weighting coefficients for the electromagnetic signal based upon the average with respect to time of the smeared electromagnetic signal.

* * * * *